US012631011B2

(12) United States Patent
Johnson

(10) Patent No.: US 12,631,011 B2
(45) Date of Patent: May 19, 2026

(54) FAUCET ASSEMBLY

(71) Applicant: AS America, Inc., Piscataway, NJ (US)

(72) Inventor: Paul Anthony Johnson, Columbia, MD (US)

(73) Assignee: AS America, Inc., Piscataway, NJ (US)

( * ) Notice: Subject to any disclaimer, the term of this patent is extended or adjusted under 35 U.S.C. 154(b) by 93 days.

(21) Appl. No.: 17/775,494

(22) PCT Filed: Nov. 13, 2020

(86) PCT No.: PCT/US2020/060364
§ 371 (c)(1),
(2) Date: May 9, 2022

(87) PCT Pub. No.: WO2021/097176
PCT Pub. Date: May 20, 2021

(65) Prior Publication Data

US 2022/0396936 A1 Dec. 15, 2022

Related U.S. Application Data

(60) Provisional application No. 62/935,745, filed on Nov. 15, 2019.

(51) Int. Cl.
*E03C 1/04* (2006.01)

(52) U.S. Cl.
CPC .... *E03C 1/0404* (2013.01); *E03C 2001/0415* (2013.01)

(58) Field of Classification Search
CPC ..... E03C 1/0404; E03C 2001/0415; F16L 11/00; F16L 33/01
(Continued)

(56) References Cited

U.S. PATENT DOCUMENTS 2,776,168 A * 1/1957 Schweda ..... E03C 1/06 4/596
2,903,710 A * 9/1959 Pearson ..... E03C 1/06 4/615
(Continued)

FOREIGN PATENT DOCUMENTS

AU 2015321662 A1 4/2017
JP H11200438 A * 7/1999 ..... E03C 1/042
(Continued)

OTHER PUBLICATIONS

JPH11200438A Translation (Year: 2023).*
(Continued)

*Primary Examiner* — David P Angwin
*Assistant Examiner* — William R Klotz
(74) *Attorney, Agent, or Firm* — Morrison & Foerster LLP

(57) ABSTRACT

A pull-out faucet assembly, comprising a faucet body comprising a proximal end and a distal end; a spray head comprising a proximal end and a distal end, wherein the spray head is configured to be releasably docked at the faucet body distal end, and the spray head distal end comprises a water outlet; and an expandable hose comprising a first downstream end coupled to the spray head proximal end and an expandable hose length running through a length of the faucet body, wherein the expandable hose is configured to fluidly connect the water outlet to a mixing valve.

18 Claims, 7 Drawing Sheets

(58) Field of Classification Search
USPC ..... 4/678; 138/118–119, 30; 239/281
See application file for complete search history.

(56) References Cited

U.S. PATENT DOCUMENTS

| | | | | |
|---|---|---|---|---|
| 6,093,313 | A | 7/2000 | Bovaird et al. | |
| 7,162,782 | B1 * | 1/2007 | Nelson | E03C 1/0404 29/225 |
| 8,757,213 | B2 * | 6/2014 | Berardi | F16L 55/1018 138/119 |
| 9,127,791 | B2 * | 9/2015 | Ragner | D03D 3/06 |
| 11,377,827 | B2 * | 7/2022 | Lee | E03C 1/021 |
| 2003/0098084 | A1 | 5/2003 | Ragner et al. | |
| 2008/0196160 | A1 * | 8/2008 | Alder | F16L 11/16 4/678 |
| 2010/0043135 | A1 * | 2/2010 | Patterson | E03C 1/06 4/612 |
| 2013/0042926 | A1 | 2/2013 | Jonte et al. | |
| 2016/0215482 | A1 * | 7/2016 | Fourman | E03C 1/0404 |
| 2016/0237663 | A1 | 8/2016 | Myers et al. | |
| 2017/0101325 | A1 | 4/2017 | Ye | |
| 2018/0073226 | A1 | 3/2018 | Esche et al. | |
| 2018/0306353 | A1 * | 10/2018 | Caplan | F16L 11/12 |
| 2020/0123741 | A1 * | 4/2020 | Huang | E03C 1/0404 |

FOREIGN PATENT DOCUMENTS

| | | | |
|---|---|---|---|
| JP | 2002138538 A | * | 5/2002 |
| JP | 2006176952 A | * | 7/2006 |
| KR | 20130003347 U | | 6/2013 |

OTHER PUBLICATIONS

JP2006176952A Machine Translation (Year: 2024).*
JP-2002138538-A Machine Translation (Year: 2024).*
PCT/US2020/060364 International Search Report and Written Opinion dated Feb. 5, 2021.

* cited by examiner

FAUCET ASSEMBLY

This relates to faucet assemblies and, particularly, to pull-out/pull-down spray head arrangements for faucet assemblies.

BACKGROUND

By nature, conventional faucets direct water flow from a stationary water outlet to a single location at the bottom of a sink basin. Conventional faucets typically have little, if any, ability to alter the location of the water outlet or the direction of the water flow. Thus, conventional faucets are very limiting for users cleaning a sink basin and/or washing items of a particular nature (i.e., large items, heavy items, oddly-shaped items, etc.) since the water flow cannot be directed to various locations within the sink basin, the faucet body may be in the way of large items (i.e., large pots) that need to be washed, and/or a user may have to lift a heavy item to the water outlet for cleaning, instead of maneuvering the water outlet to a heavy item resting on the bottom of the sink basin, for example.

Many modern faucets, and in particular, modern kitchen faucets, are now equipped with pull-out spray heads. With a pull-out spray head, a user can pull the spray head away from the body of the faucet. When the spray head is pulled away from the faucet body, a water supply hose attached to the spray head slides through the faucet body and extends out of the faucet body. Thus, a user is able to direct water flow in any direction that the attached flexible hose can accommodate. Pull-out spray heads also enable users to move the water source to an item to be cleaned, instead of requiring the user to deliver the item to the water source. This is particularly helpful for items that may be large, heavy, or oddly-shaped, such as large and heavy pots and pans and/or large cookie sheets.

SUMMARY

As discussed above, pull-out (or pull-down) faucet assemblies include a spray head that a user can pull away from the faucet body. When the spray head is pulled away, it remains connected to the faucet assembly by a water supply hose. The water supply hose is typically attached to the spray head at the same location at which the spray head couples to the faucet body (a location opposite the water outlet). The water supply hose travels or slides through the faucet body as the spray head moves away from, and back towards, the faucet body. Thus, a slack length of hose (located underneath the faucet or sink) is required such that a length of the hose is able to slide out of the faucet body along with the spray head, while the opposing end of the hose remains connected to the water supply. Further, the assembly is often equipped with a weight or spring mechanism such that the hose (and spray head) retract once released. The terms "pull-out" and "pull-down" are employed interchangeably herein.

However, a conventional pull-out spray head faucet assembly having a hose with a slack length, as described above, has several limitations. For example, it can be difficult to install, cumbersome to replace and/or fix, and take up space underneath the sink. Further, pull-out spray head arrangements also pose design limitations. For example, the faucet body must be wide enough to accommodate the size of the hose and to allow it to slide back and forth within the body of the faucet. Further, pull-out faucet arrangements requiring a slack hose length are not suitable for use with some modern faucet designs, such as 3D-printed faucets.

Accordingly, provided herein are improved pull-out spray head faucet assemblies that may address one or more of the problems discussed above.

Pull-out spray head faucet assemblies according to embodiments described herein may include a water supply hose that is configured to expand under pressure and/or when manually pulled. In some embodiments, the water supply hose may include an inner tubing and an outer sheath. As with conventional pull-out spray head faucet assemblies described above, when a faucet assembly is turned "on", water is delivered from the water supply to the water outlet disposed at the end of a spray head. According to some embodiments, the water pressure generated by turning the water on can cause the water supply hose to expand. Accordingly, when the spray head is pulled away from the faucet body, the water supply hose can extend from the faucet body by expanding length-wise instead of sliding through the faucet body as described above in conventional pull-out spray head faucet assemblies. Some embodiments can also include a bellows and/or a piston mechanism.

In some embodiments, an expandable hose may comprise one or more "coiled" portions. In some embodiments, an expandable hose may substantially entirely be a coiled hose. An expandable hose may comprise one or more coiled portions and one or more "standard" or conventional hose sections. A "coiled" portion or section may be configured to expand upon a spray head being pulled out and/or down from a faucet body.

In some embodiments, a coiled portion may be coupled to a water source and a standard hose portion and disposed in a faucet body, and a standard hose portion is coupled to a spray head. In some embodiments, a coiled portion may not be visible to a user upon pulling the spray head out or down. In other embodiments, a hose coiled portion may be coupled to a spray head, and to a water source or a standard hose portion, and may be visible upon pulling a spray head out or down.

In some embodiments, a hose coiled portion may comprise one or more of a rubber, an elastomer, a latex or neoprene. In some embodiments, an expandable hose comprising one or more coiled portions may comprise one or more compression or expansion springs which may be configured to aid in recoiling the hose and docking the spray head. In some embodiments, a spring may be disposed within a center of a coiled hose section and may be coupled to one or more parts of a standard or coiled hose section. In some embodiments, a spring may be "interwoven" with the coils. In other embodiments, a spring may be coupled to an exterior of a coiled or standard hose section.

In some embodiments, a release mechanism may not be required. In some embodiments, water pressure may assist in pulling a spray head out and/or docking a spray head.

In some embodiments, an expandable hose may comprise a single fluid channel or may be multi-channeled. Multiple hose channels may carry mixed tap water, filtered water, treated water (e.g. ozone treated water), cold water, hot water, etc.

In some embodiments, a coiled hose section may comprise a single channel. In other embodiments, a coiled hose section may comprise more than one fluid channel, for example two or three fluid channels coiled together or separately. In some embodiments, a standard hose portion may also comprise multiple channels and may be configured to couple to a multi-channeled coiled section.

In some embodiments, expandable hoses of the disclosure require no pull-down or counter weight. In some embodiments, expandable hoses of the disclosure do not require a long length (as they are expandable) and may not require any "slack" length for pull-out or pull-down action.

In some embodiments, a pull-out spray head faucet assembly may include a release mechanism configured to couple the spray head to the faucet body. For example, oftentimes a user may use the faucet without needing to utilize the pullout spray head feature. Thus, a release mechanism may be included to hold the spray head to the faucet body. Specifically, the release mechanism may be configured to hold the spray head to the faucet body when the faucet is turned on and the water travelling from the water supply to the water outlet exerts pressure on the expandable hose. In this case, instead of the expandable hose expanding lengthwise and extending out from the faucet body, the expandable hose may expand predominantly in a radial direction within the faucet body. Thus, unless and until a user disengages the release mechanism coupling the spray head to the faucet body, the expandable water hose will only expand within the faucet body to the extent possible (mostly radial expansion with some length-wise expansion) and will not extend out from the faucet body. In some embodiments, the expandable hose may not expand radially or length-wise. For example, the expandable hose may not expand radially or length-wise when the spray head is coupled to the faucet body, even when the faucet is turned on.

While the present disclosure discusses pull-out spray heads with reference to faucet assemblies, it should be noted that pull-out spray heads in accordance with the present disclosure may be used not only for faucet assemblies, but may instead be used for side sprayers often used in conjunction with a conventional, stationary faucet.

In some embodiments, a pull-out faucet assembly is provided, the pull-out faucet assembly comprising: a faucet body comprising a proximal end and a distal end; a spray head comprising a proximal end and a distal end, the distal end comprising a water outlet, and the proximal end configured to be releasably dockable at the distal end of the faucet body; an expandable hose comprising a first end of the expandable hose coupled to the proximal end of the spray head and a length of the expandable hose running through a length of the faucet body, wherein the expandable hose is configured to fluidly connect the water outlet to a mixing valve; and a release mechanism comprising a coupling means configured to hold the proximal end of the spray head to the distal end of the faucet body when the coupling means is engaged.

In some embodiments of the pull-out faucet assembly, the expandable hose comprises an inner tubing and an outer sheath.

In some embodiments of the pull-out faucet assembly, the expandable hose is configured to expand radially.

In some embodiments of the pull-out faucet assembly, the expandable hose is configured to expand length-wise.

In some embodiments of the pull-out faucet assembly, the spray head is in a docked position when the coupling means of the release mechanism is engaged and holding the proximal end of the spray head to the distal end of the faucet body.

In some embodiments of the pull-out faucet assembly, the spray head is configured to pull away from the distal end of the faucet body when the expandable hose expands and the coupling means of the release mechanism is disengaged.

In some embodiments of the pull-out faucet assembly, the spray head is configured to remain in a docked position with the coupling means of the release mechanism engaged when the faucet is in operation.

In some embodiments of the pull-out faucet assembly, an inner tubing of the expandable hose comprises one or more of rubber, latex, or polychloroprene (neoprene).

In some embodiments of the pull-out faucet assembly, an outer sheath of the expandable hose restricts the inner tubing from expanding such that the inner tubing does not achieve plastic deformation or failure.

In some embodiments of the pull-out faucet assembly, the coupling means of the release mechanism comprises a magnetic mechanism, a latching mechanism, a twisting mechanism, or a gripping mechanism.

In some embodiments of the pull-out faucet assembly, the expandable hose is configured to fluidly connect the water outlet to the mixing valve such that a slack length of hose is not required.

In some embodiments, a pull-out faucet assembly is provided, the pull-out faucet assembly comprising: a faucet body comprising a proximal end and a distal end; a spray head comprising a proximal end and a distal end, the distal end comprising a water outlet and the proximal end disposed at the distal end of the faucet body; a release mechanism comprising a coupling means configured to hold the proximal end of the spray head to the distal end of the faucet body when the coupling means is engaged; a hose comprising a first end coupled to the proximal end of the spray head and a length of the hose running through a length of the faucet body; and a piston mechanism coupled to a second end of the hose.

In some embodiments of the pull-out faucet assembly, the spray head is in a docked position when the coupling means of the release mechanism is engaged and holding the proximal end of the spray head to the distal end of the faucet body.

In some embodiments of the pull-out faucet assembly, the piston mechanism comprises a piston and a spring.

In some embodiments, a pull-out faucet assembly may comprise a bellows mechanism, wherein the mechanism comprises a bellows and a spring.

In some embodiments of the pull-out faucet assembly, the spray head is configured to pull away from the distal end of the faucet body when the piston slides in the faucet body and the coupling means of the release mechanism is disengaged.

In some embodiments of the pull-out faucet assembly, the piston is configured to slide back and forth between two positions within the faucet body, wherein the piston is in a first position when the spray head in a docked position, and the piston is in a second position when the spray head is pulled away from the distal end of the faucet body to its fullest extent.

In some embodiments of the pull-out faucet assembly, the piston is configured to slide between the first position and the second position when pressurized by water flow, that is, when force is applied to the piston by water flow.

In some embodiments of the pull-out faucet assembly, the spray head is configured to remain in a docked position with the coupling means of the release mechanism engaged when the faucet is in operation.

In some embodiments of the pull-out faucet assembly, the spring of the piston mechanism expands when the spray head is pulled away from the distal end of the faucet body and the piston is in the second position, and the spring contracts as the spray head moves towards the distal end of the faucet body until the piston is in the first position.

In some embodiments of the pull-out faucet assembly, the coupling means of the release mechanism comprises a magnetic mechanism, a latching mechanism, a twisting mechanism, or a gripping mechanism.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DESCRIPTION

Figure 1A:
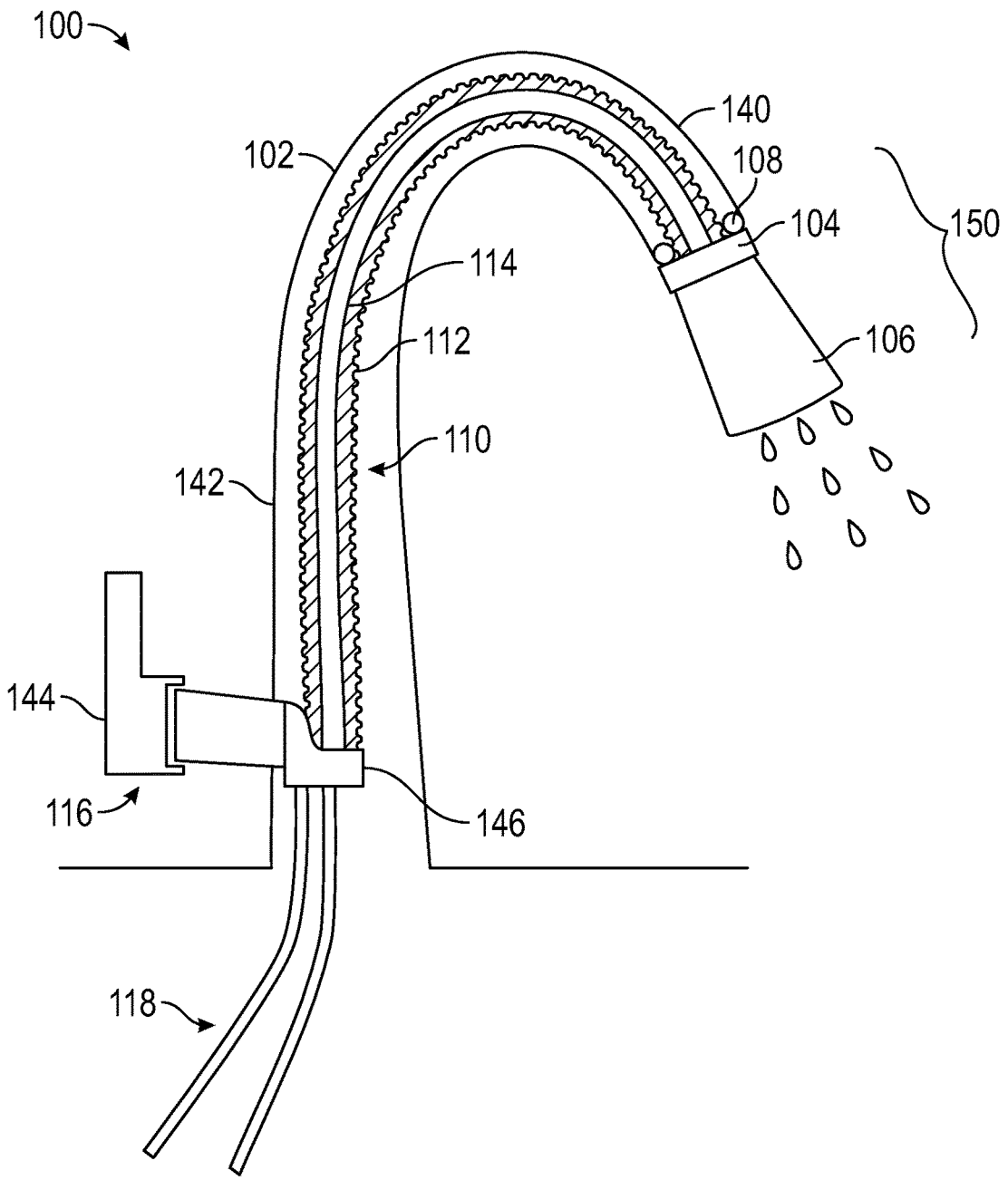
FIG. 1A and FIG. 1B show a pull-out spray head faucet assembly according to some embodiments.

Described herein are exemplary embodiments of pull-out spray heads that may provide for less cumbersome installation and repair and may also be less restrictive on faucet body design.

Pull-out spray head faucet assemblies may provide for less cumbersome installation and repair. Specifically, conventional pull-out spray head faucet assemblies require a reserve, slack length of hose to allow the spray head to be pulled away from the faucet body. Often, this reserve, slack length of hose is underneath a sink or behind the mounted faucet, for example. When the spray head is pulled away from the faucet body, the hose attached to the spray head is pulled along with it. Thus, in order for the spray head to be pulled away from the faucet body and still have a steady stream of water supply, the slack length of hose slides from its resting position (i.e., underneath the sink basin or behind the mounted faucet) and through the faucet body while remaining connected to the main water supply. A portion of the hose length located nearest to the spray head extends out of the faucet body as required by the force pulling the spray head. Thus, this reserve, slack length of hose can be cumbersome to install and repair.

However, pull-out spray heads according to embodiments disclosed herein do not require this reserve, slack length of hose. Instead, an expandable hose may be mounted within the faucet body. In some embodiments, the expandable hose may be mounted directly to the water source (or plumbing supply). Regardless of where the expandable hose is mounted, a slack length of hose is not required to allow the spray head to pull away from the faucet body, since the expandable hose is configured to expand length-wise when subjected to water pressure. Accordingly, embodiments of pull-out spray head faucet assemblies provided herein may be less cumbersome to install and easier to repair or replace, since a shorter length of hose is required, streamlining the component parts and design of the overall faucet assembly.

Additionally, pull-out spray head faucet assemblies according to embodiments provided herein may be less restrictive on some faucet designs. For example, conventional pull-out spray head faucet assemblies described above require a slack length of hose to pass back-and-forth through the faucet body as the spray head is pulled away from and directed back towards the faucet body. Thus, the width of the faucet body must be large enough to accommodate not only the water supply hose, but also the sliding back-and-forth motion of the hose through the faucet body. Additionally, the aesthetic of some specific types of modem faucets are not designed to accommodate a hose passing through the entire length of the faucet body, such as the hose of a conventional pull-out faucet assembly. For example, 3D-printed faucet assembles include void spaces through the faucet body as part of the design, and the entire length of the faucet body is not enclosed, as it is with conventional designs. Thus, the faucet body of 3D-printed faucet designs are often unable to accommodate the hose of a conventional pull-out spray head faucet assembly. However, embodiments of pull-out spray head faucet assemblies provided herein may be less restrictive on some faucet designs and may even be able to be incorporated in some faucet designs where a conventional pull-out spray head is impractical. Specifically, by using an expandable hose, as described in detail below, there is no need for the hose to pass back-and-forth as required with a conventional pull-out spray head design. Accordingly, the width of the faucet body can not only be narrower, but it can also be partially unenclosed, as in many 3D-printed faucet designs. Instead, the expandable hose may be installed only in an upper portion of the faucet body, where the faucet body is enclosed, without interfering with the aesthetic design of the faucet.

Various embodiments of pull-out/pull-down spray head faucets are described below in detail with reference to the figures included herein.

FIG. 1A depicts a pull-out/pull-down spray head faucet assembly ("faucet assembly") 100, according to an embodiment. Faucet assembly 100 includes faucet body 102 (shown in cross-section), having distal end 140 and proximal end 142, spray head 150, having proximal end 104 and distal end 106, release mechanism 108, and hose 110 (shown in cross-section). Spray head 150 of faucet assembly 100 is in a docked position. Spray head 150 may be in a docked position when proximal end 104 of spray head 150 is coupled to the distal end of faucet body 102. Additionally, spray head 150 may be in a docked position with or without an engaged release mechanism.

As used herein, the terms "docked position", "docking", "docked", and variations are used to refer to a spray head coupled to a faucet body, such that the attached hose does not extend outwardly from the faucet body.

Faucet body 102 can include a cylindrical housing configured to enclose hose 110. A distal end of faucet body 102 may be configured to mount to a surface such as a countertop, a sink top, a wall, and/or a floor. Distal end 140 of faucet body 102 may be configured to couple to proximal end 104 of spray head 150. In some embodiments, a release mechanism 108 may be disposed at distal end 140 of faucet body 102. Release mechanism 108 (described in more detail below) may be configured to hold proximal end 104 of spray head 150 to distal end 140 of faucet body 102.

Spray head 150 of faucet assembly 100 may include proximal end 104 and distal end 106. Proximal end 104 may be configured to couple to distal end 140 of faucet body 102, as described above. Additionally, a first end of hose 110 can be attached to proximal end 104 of spray head 150. In some embodiments, hose 110 can be attached to a main water supply or an additional conduit, and can be configured to transport water from a water source to a water outlet. For example, water can be delivered from a water supply, through hose 110 to proximal end 104 of spray head 150, and through spray head 150 to a water outlet located at distal end 106 of spray head 150.

In some embodiments, release mechanism 108 may be disposed at distal end 140 of faucet body 102 or at proximal end 104 of spray head 150. In some embodiments, release mechanism 108 may comprise one or more components disposed on distal end 140 of faucet body 102 and one or more components disposed on proximal end 104 of spray head 150. Release mechanism 108 may be configured to hold spray head 150 to faucet body 102, for example, when spray head 150 is in a docked position. Release mechanism 108 may incorporate various coupling means to hold spray head 150 to faucet body 102. For example, possible coupling means that can be used to hold proximal end 104 of spray head 150 to distal end 140 of faucet body 102 include a magnetic mechanism, a latching mechanism, a twisting mechanism, a gripping mechanism, and other suitable coupling means. In some embodiments, a user may manually disengage release mechanism 108, causing proximal end 104 of spray head 150 to decouple from distal end 140 of faucet body 102. For example, a user may apply a strong pulling force on spray head 150 to overcome the strength of a magnet in the case of a magnetic mechanism or to overcome the frictional force in the case of a gripping mechanism. In some embodiments, a user may press a button that is configured to release the coupling means of release mechanism 108. For example, a user may press a button that causes a latch to release spray head 150 in the case of a latching mechanism, causes a magnet to demagnetize and release spray head 150 in the case of a magnetic mechanism, and/or causes a gripper to expand and release spray head 150 in the case of a gripping mechanism.

Figure 1B:
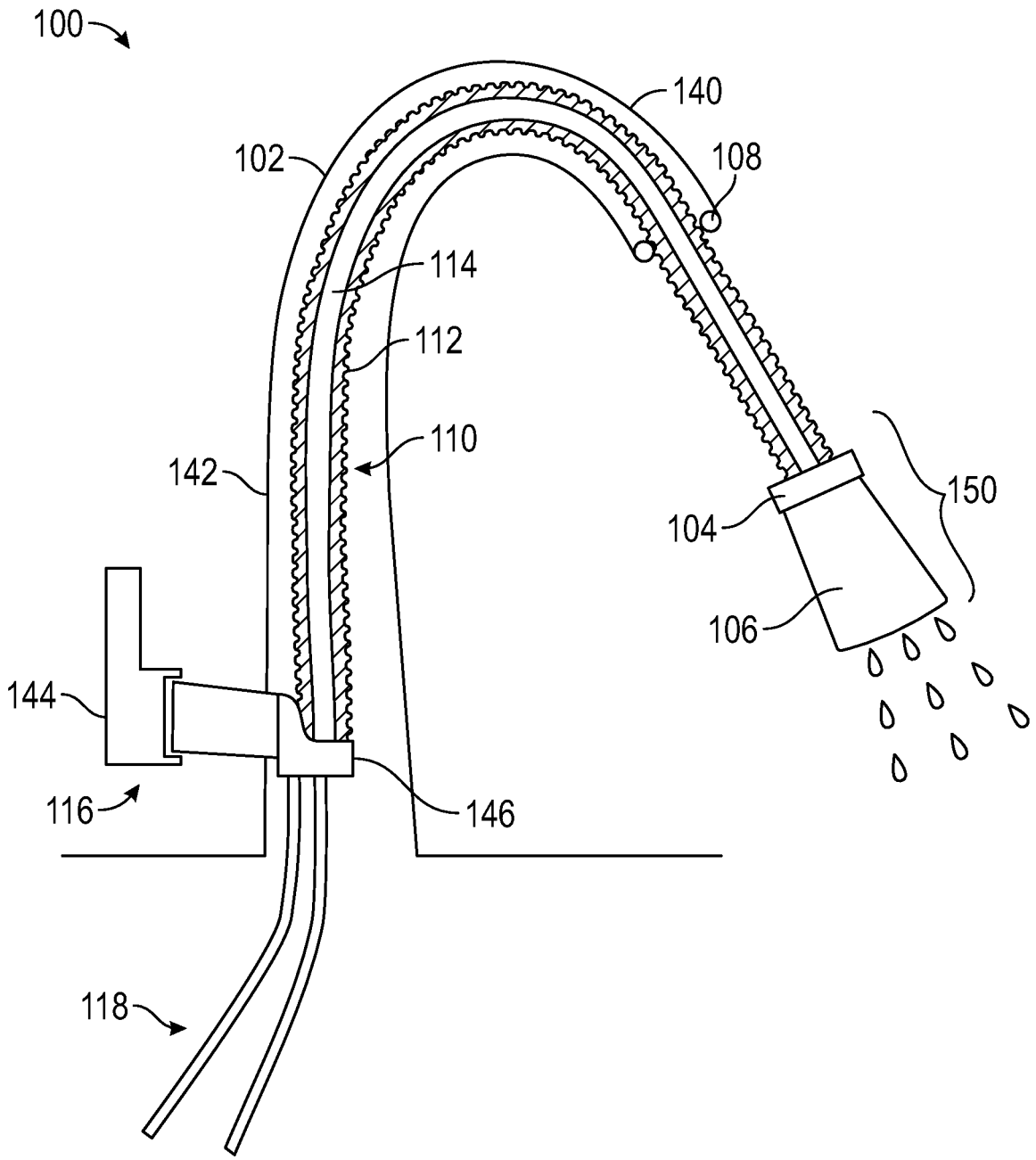

Hose 110 of the pull-out spray head faucet assembly 100 may include various materials and features. In some embodiments, hose 110 may be expandable. For example, when a user turns the faucet assembly "on", and water begins to flow from the water supply to the water outlet of spray head 150, the pressure from the water flow can cause hose 110 to expand radially and/or length-wise. As shown in FIG. 1A, spray head 150 is in a docked position, meaning that proximal end 104 of spray head 150 is coupled to distal end 140 of faucet body 102. Thus, when a user turns the faucet "on", and water transfers from the water supply through hose 110 to spray head 150, pressure generated by the water flow forces hose 110 to expand. So long as release mechanism 110 is engaged and holding proximal end 104 of spray head 150 to distal end 140 of faucet body 102, hose 110 will predominately expand in a radial direction, to the extent the width of faucet body 102 allows. FIG. 1B demonstrates an embodiment of an expandable hose 110 when spray head 150 is pulled out from faucet body 102 (and not in a docked position).

In some embodiments, hose 110 may comprise inner tubing 114 and an outer sheath 112. Inner tubing 114 can include flexible, expandable material and behave much like a balloon when subjected to water pressure by water flowing through hose 110. In some embodiments, the force required for inner tubing 114 to expand radially may be less than the force required for it to expand length-wise. Flexible, expandable material of inner tubing 114 can include rubber, latex, polychloroprene, and/or other suitable materials. Outer sheath 112 can include a flexible, strong material. For example, outer sheath 112 may be flexible to allow manipulation and movement of the hose (to form to the interior of faucet body 102 as well as enabling a user to fluidly move a pulled-out spray head in various directions). However, outer sheath 112 may also be strong and durable to prevent inner tubing 114 from over-expanding, which could lead to plastic deformation and/or failure of hose 110.

Additionally, outer sheath 112 also provides control of expandable hose 110. For example, as described above, the force required for inner tubing 114 to expand radially may be less than the force required for inner tubing 114 to expand length-wise. Thus, inner tubing 114 may expand radially until it conforms to the interior of outer sheath 112. At this point, the force required to expand outer sheath 112 radially may be greater than the force required for the inner tubing 114 to expand length-wise. Thus, inner tubing 114 may expand predominantly radially until it conforms to the interior of outer sheath 112, at which point it will expand length-wise. This behavior is particularly useful for enabling a user who wishes to operate spray head 150 in a pulled-out configuration.

Other features provided in FIG. 1A include a water control assembly 116 and hot/cold water supply conduit 118. Water control assembly 116 and hot/cold water supply conduit 118 are only provided for reference, and are not intended to limit faucet assembly 100 provided herein.

Water control assembly 116 is provided with a single handle configured to operate a mixing valve. For example, faucet assembly 100 may comprise single handle 144 configured to manipulate mixing valve 146, controlling the ratio of hot water to cold water that flows from the water supply, to hose 110 of faucet body 102, and through the water outlet disposed on distal end 106 of spray head 150. In some embodiments, water control assembly 116 may include two or more handles 144 with a single mixing valve 146 serving the two or more handles. Water control assembly 116 may also include two valves, one for each of two handles. Further, FIG. 1A shows that water control assembly 116 located at a base of faucet body 102, with mixing valve 146 located within faucet body 102. In some embodiments, water control assembly 116 may instead be located proximate to faucet body 102 along with accompanying valves for controlling water flow. For example, a valve controlling the inward flow of hot/cold water may be located on an opposite side of a mounting surface from faucet body 102 (i.e., sink top, countertop, floor, wall, etc.). Such valve could also be located within a shell or housing that may be part of the pull-out spray head faucet assembly 100 or separate from faucet assembly 100. The hot/cold water supply hosing 118 is configured to transfer water directly from the main water supply to water control assembly 116.

FIG. 1B shows pull-out spray head faucet assembly 100 with spray head 150 extended from faucet body 102. Faucet assembly 100 can include any and/or all of the features described above with reference to faucet assembly 100, including faucet body 102 (shown in cross-section), having proximal end 142 and distal end 140 and spray head 150, having proximal end 104 and distal end 106. However, FIG. 1B shows a pulled-out spray head instead of the docked spray head depicted in FIG. 1A. Thus, release mechanism 108 has been disengaged to allow spray head 150 to be pulled away from distal end 140 of faucet body 102. As described above, release mechanism 108 may comprise a coupling means to hold proximal end 104 of spray head 150 to distal end 140 of faucet body 102. For example, coupling means may be a magnetic mechanism, a latching mechanism, a twisting mechanism, a gripping mechanism, or other suitable coupling means. In FIG. 1B, release mechanism 108 has been disengaged by unlatching, untwisting, applying a force, demagnetizing, and/or any other operation necessary to disengage the coupling means of release mechanism 108 and enable a user to pull spray head 150 away from faucet body 102.

Hose 110 is shown in cross-section. A portion of hose 110 proximate to proximal end 104 of spray head 150 may extend outward from distal end 140 of faucet body 102 to allow spray head 150 to be pulled away from distal end 140 of faucet body 102. At the same time, the end of hose 110 opposite spray head 150 may remain coupled to the main water supply or an intermediate conduit attached to the main water supply (i.e., hot and cold water lines 118).

As discussed above, when a user turns the faucet assembly 100 "on" using handle 144 of water control assembly 116, it can cause water to transfer from the water supply to faucet assembly 100. Further, this transfer of water generates an influx of pressure on hose 110. Under pressure, hose 110 may expand radially and/or length-wise. Further, as described above, hose 110 may include at least two separate parts-inner tubing 114 and outer sheath 112. Inner tubing 114 can be configured to expand much like a balloon in radial and/or length-wise directions. Outer sheath 112 may, when spray head 150 is in a docked position, collapse in size much like a concertina or bellows. For example, when outer sheath 112 is not in a completely open/expanded configuration, material of the sheath may fold over itself, creating a zig-zag formation, or rib-like protrusions running along the circular perimeter of the inner tubing, as shown. Inner tubing 114 can contract and/or collapse in size when not under pressure. Thus, when the faucet assembly is in an "off" configuration, inner tubing 114 can collapse and outer sheath 112 can contract such that spray head 150 can rest in a docked position without forming a slack length of hose 110, as required of conventional pull-out spray head faucet assemblies. As shown in FIG. 1B, when faucet assembly 100 is turned "on", water flow pressurizes hose 110. Thus, inner tubing 114 expands radially (within outer sheath 112 and faucet body 102) and length-wise (extending out from a distal end of faucet body 102) and outer sheath 112 opens as required by the expanding inner tubing 114. Thus, outer sheath 112 may open a limited amount radially within faucet body 102; this limited radial opening by outer sheath 112 can be designed to restrict inner tubing from over-expanding radially and causing plastic deformation and/or failure to hose 110. Outer sheath 112 can also open length-wise, much like a concertina or bellows-type mechanism. As with radial over-expansion of inner tubing 114, outer sheath 112 may be designed such that it can open length-wise just enough to allow spray head 150 to be able to reach the desired distance, and such that inner tubing 114 cannot over-expand length-wise and cause plastic deformation and/or failure to hose 110 as well.

Figure 2:
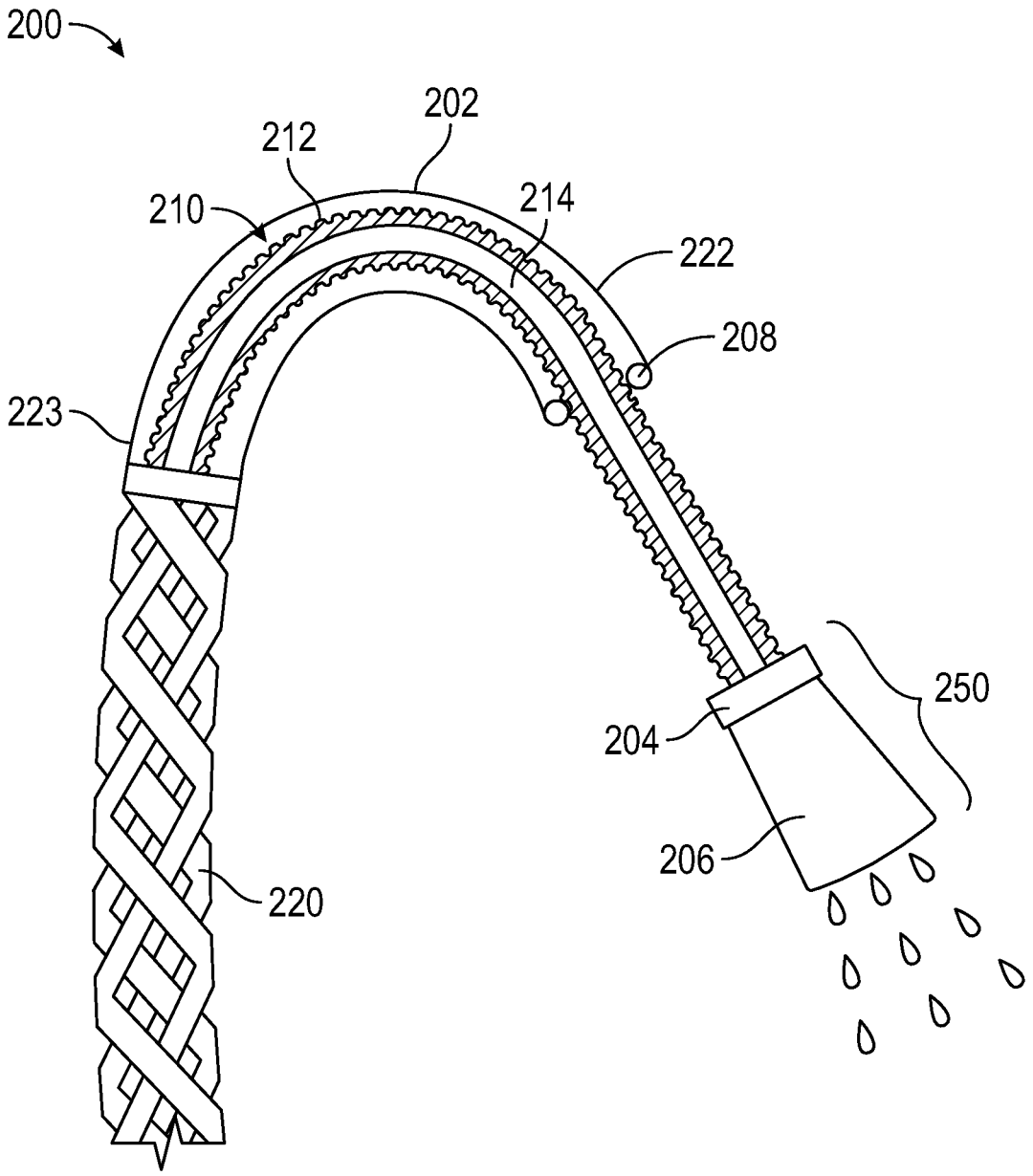
FIG. 2 depicts a pull-out spray head faucet assembly having a 3D-printed design according to some embodiments.

FIG. 2 provides another example of a pull-out spray head faucet assembly 200. Specifically, FIG. 2 provides an example of a pull-out spray head integrated with a modern faucet design. For example, many 3D-printed faucet designs, like the one depicted in FIG. 2, include illusive features such as the lattice design of proximal end 220 of faucet body 202. Specifically, the faucet design of FIG. 2 features proximal end 220 including numerous small waterways intertwined and converging at proximal end 223 of faucet body 202 (shown in cross-section). The small waterways of proximal end 220 are intertwined such that the faucet body is not a single, hollow, cylindrical housing like that of faucet assembly 100. Instead, the numerous small waterways are surrounded by void space. Accordingly, it would be impractical and aesthetically unpleasing to integrate a conventional pull-out spray head with the faucet design of FIG. 2, since the non-expandable hose of a conventional pull-out spray head is required to pass back-and-forth through the entire length of the faucet body. Having a hose pass back-and-forth through the entire length of faucet body 202 would be impractical, since proximal end 220 of faucet body 202 is not fully enclosed (only the individual small waterways are fully enclosed).

However, using an expandable hose 210 (shown in cross-section) enables a pull-out spray head to be integrated into faucet assembly 200 without sacrificing aesthetic. As shown in FIG. 2, expandable hose 210 can be mounted within distal end 222 of faucet body 202. Thus, using the expanding mechanisms described above, expandable hose 210 can expand radially and length-wise when pressurized by water flow to allow spray head 250 to be pulled away from distal end 222 of faucet body 202.

Just as with the previously-depicted pull-out spray head faucet assemblies, faucet assembly 200 may also include a release mechanism 208, expandable hose 210 may include inner tubing 214 and outer sheath 212, and spray head 250 may include a proximal end 204 (where hose 210 is attached) and distal end 206 (having a water outlet). Additionally, a water control assembly and hot/cold water supply hosing may also be included.

Figure 3:
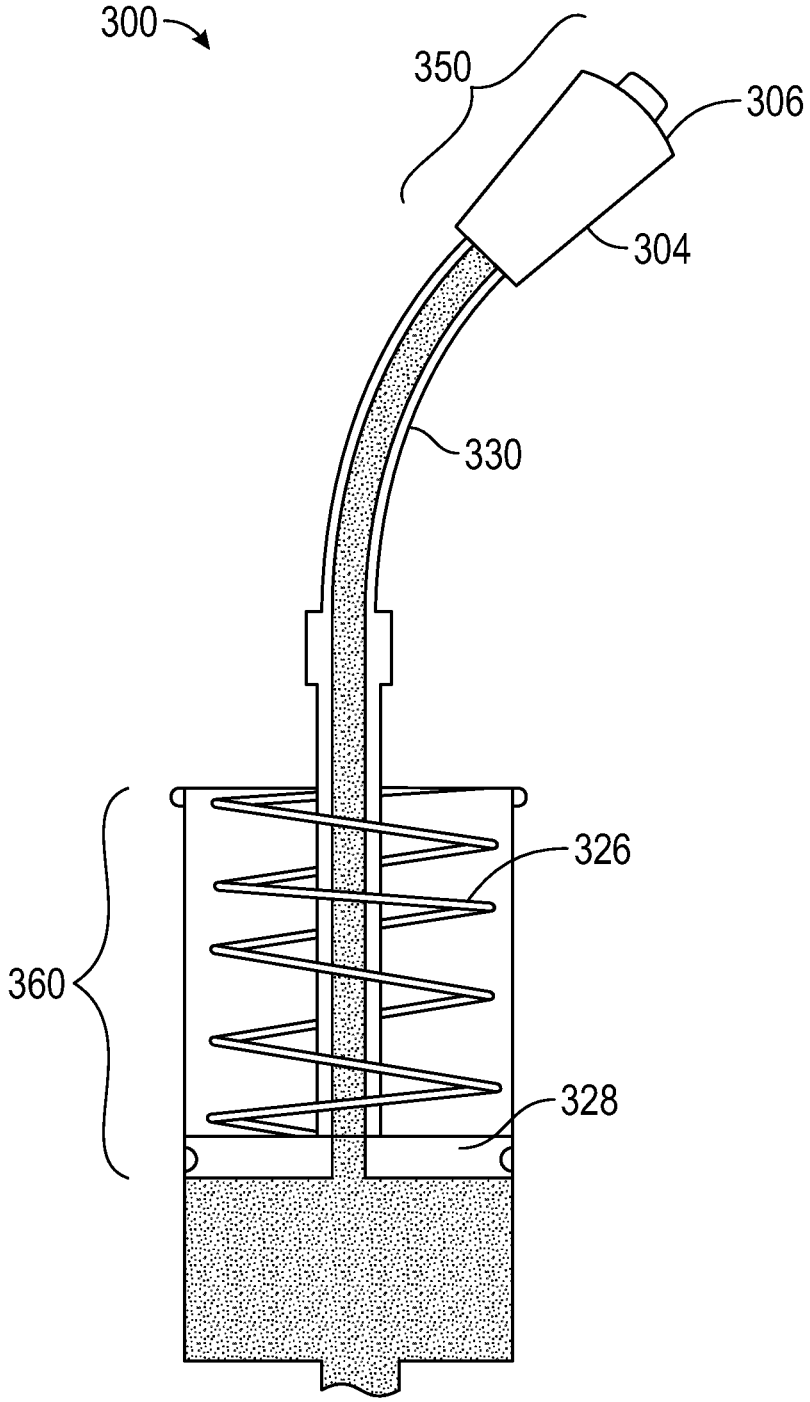
FIG. 3 shows a pull-out spray head faucet assembly comprising a piston mechanism according to some embodiments.

FIG. 3 depicts a pull-out spray head faucet assembly 300 according to some embodiments (shown in cross-section except spray head 350). In some embodiments, faucet assembly 300 may include a conventional water hose instead of an expandable hose. Faucet assembly 300 may also include a spray head having a proximal end 304 and a distal end 306, a faucet body, a release mechanism configured to hold proximal end 304 of spray head 350 to the faucet body, a water control assembly, and hot/cold water supply tubing.

In some embodiments, faucet assembly 300 may include piston mechanism 360 configured to allow spray head 350 to be pulled away from and directed back towards the distal end of the faucet body. For example, piston mechanism 360 may comprise a piston 328 and a spring 326. By using piston mechanism 360 with a conventional hose, a pull-out spray head can be implemented into a faucet design without the need for a slack length of hose, as required in conventional pull-out spray head faucet designs, described above. In some embodiments, piston 328 can be coupled to hose 330. Thus, when water flows into piston mechanism 360 from a water supply and any release mechanism is disengaged, the force of the water flow can cause piston 328 to slide upwards, which pushes hose 330 upwards, and in turn pushes spray head 350 outward and away from the faucet body. Thus, when the water flows into the piston mechanism 360, pressure from the water flow can push the piston from an "off" (or resting) location to an "on" location while at the same time forcing some water to pass through an opening in piston 328 leading to hose 330 and out of spray head 350.

In some embodiments, faucet assembly 300 may be used with a release mechanism engaged. As described above, a release mechanism according to embodiments described herein may be configured to hold proximal end 304 of spray head 350 to a distal end of the faucet body. In some embodiments, the release mechanism may be disposed at proximal end 304 and/or a distal end of the faucet body. The release mechanism may also be located within the faucet body, configured to hold in place piston 328 unless disengaged. In some embodiments, the force of the water flow when the faucet is "on" is less than the force required to overcome the release mechanism. Accordingly, when the release mechanism is engaged, a user may use the faucet without taking advantage of the pull-out spray head feature. Unless the release mechanism is disengaged, spray head 350 can remain coupled to the faucet body, with the release mechanism configured such that it can hold proximal end 304 of spray head 350 to the distal end of the faucet body, even when the faucet is "on" and water flow is pushing against piston 328. Thus, when the faucet is being operated without pulling out spray head 350, the release mechanism can remain engaged so long as the force of the water flow is less than the force required to overcome the force of the release mechanism holding spray head 350 to the faucet body.

In some embodiments, faucet assembly 300 includes a mechanism to return spray head 350 to a docked position once the faucet is turned "off," the water flow stops, and the user releases spray head 350. For example, FIG. 3 shows a spring 326 within the piston mechanism 360. Spring 326 can be attached at one end to piston 328, and at the opposing end to hose 330. When the faucet assembly is "off", the piston can be in an "off" position that corresponds to a resting position for spring 326. When the faucet assembly is "on" and spray head 350 is fully extended outward from the faucet body, the piston 328 is in an "on" position and the spring is fully contracted. Piston 328 can be in any position between its "off" position and its "on" position, and spring 326 may be between a fully contracted position and a resting position, as spray head 350 extends outward from the faucet body and retracts back toward the faucet body.

As mentioned above, when spray head 350 is pulled away from the faucet body (along with hose 330), spring 326 can contract as piston 328 is pushed by the water flow. Thus, once the water flow stops pushing on piston 328, the force of contracted spring 326 can cause the spring to extend back to a resting position, forcing piston 328 back to its "off" location when all forces applied to spray head 350 are released (i.e., water flow, pull from user, etc.).

Figure 4:
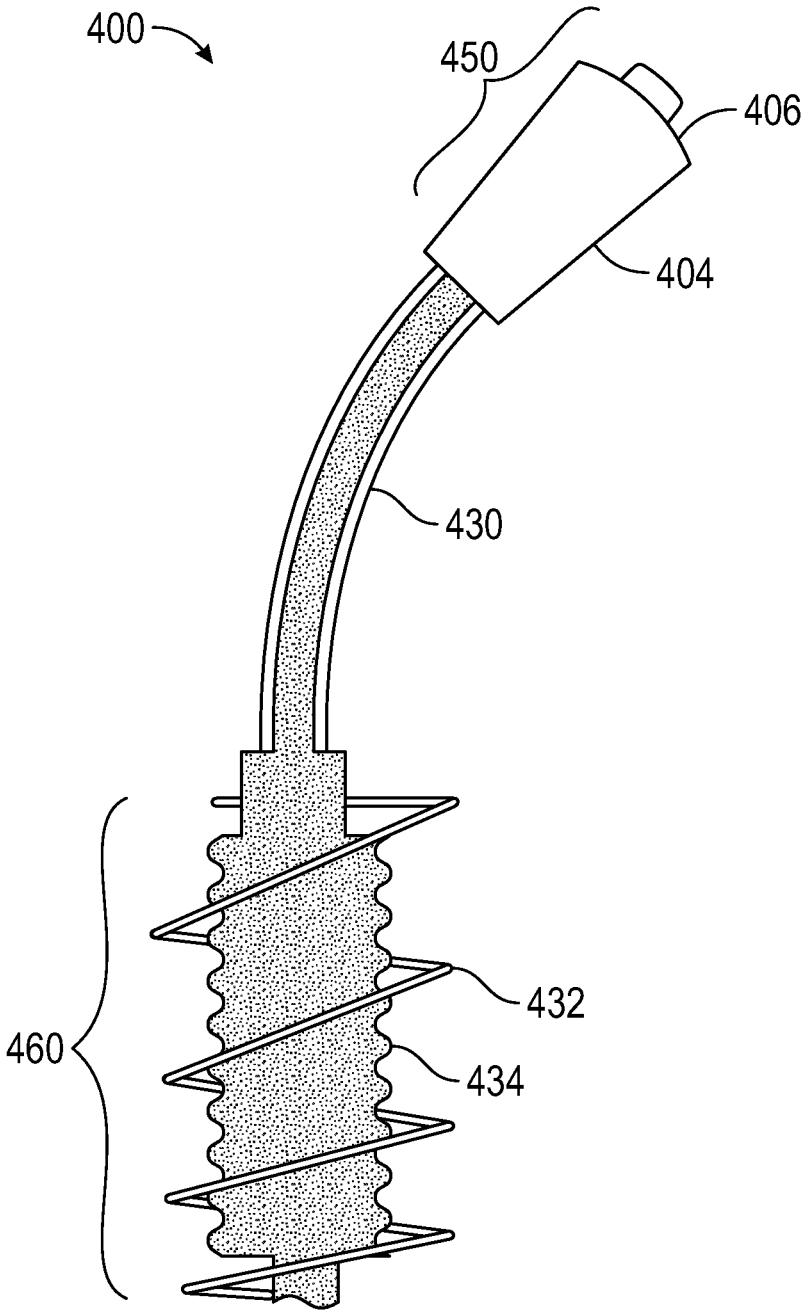
FIG. 4 shows a pull-out spray head faucet assembly comprising a bellows mechanism according to an embodiment.

FIG. 4 shows pull-out spray head faucet assembly 400 according to some embodiments (shown in cross-section except spray head 450). In some embodiments, faucet assembly 400 can include conventional water hose 430 or an expandable hose. Additionally, faucet assembly 400 may include a spray head having proximal end 404 and distal end 406, a faucet body, a release mechanism configured to hold proximal end 404 of spray head 450 to the faucet body, a water control assembly, and hot/cold water supply tubing.

In some embodiments, faucet assembly 400 may include a bellows mechanism 460. For example, bellows mechanism 460 may comprise hose 430, running the entire length of the faucet body. In some embodiments, bellows mechanism 460 may comprise bellows 434 in addition to conventional hose 430, with bellows 434 coupled to hose 430. Bellows mechanism 460 can also be applied to embodiments including an expandable hose, such as those depicted in FIG. 1A, FIG. 1B and FIG. 2.

In some embodiments, bellows mechanism 460 may expand length-wise. When spray head 450 is in a docked position, bellows mechanism 460 may be fully contracted. In this embodiment, bellows 434 is associated with compression spring 432 which may aid in retracting pray head 450 to a docked position. As depicted in FIG. 4, a contracted bellows mechanism 460 has rib-like protrusions extending outwardly from a center axis running the length of bellows mechanism 460. The protrusions can extend outwardly from the center axis, creating circular ribs running the circular perimeter of the cylindrical bellows mechanism 460. Thus, numerous circular ribs may be stacked up and down along the length of the bellows mechanism 460. When the faucet is turned "on", water is transferred from a water supply to the faucet assembly 400. As water enters the bellows mechanism 460, the force of the water flow can cause the bellows mechanism 460 to expand.

When the bellows mechanism 460 expands length-wise, it can cause the hose 430 to slide through the faucet body, allowing spray head 450 to decouple and pull away from the distal end of the faucet body (so long as any release mechanism is disengaged). Conversely, if a user needs to use faucet assembly 400 without the pull-out spray head feature, a release mechanism can remain engaged during use of the faucet, keeping proximal end 406 of spray head 450 coupled to a distal end of the faucet body. In this situation, the release mechanism can overcome any force caused by the water flow pushing on the bellows mechanism 460, keeping the bellows mechanism 460 in a contracted position and spray head 450 coupled to the faucet body while water flows through and out of the faucet spray head.

Figure 5A:
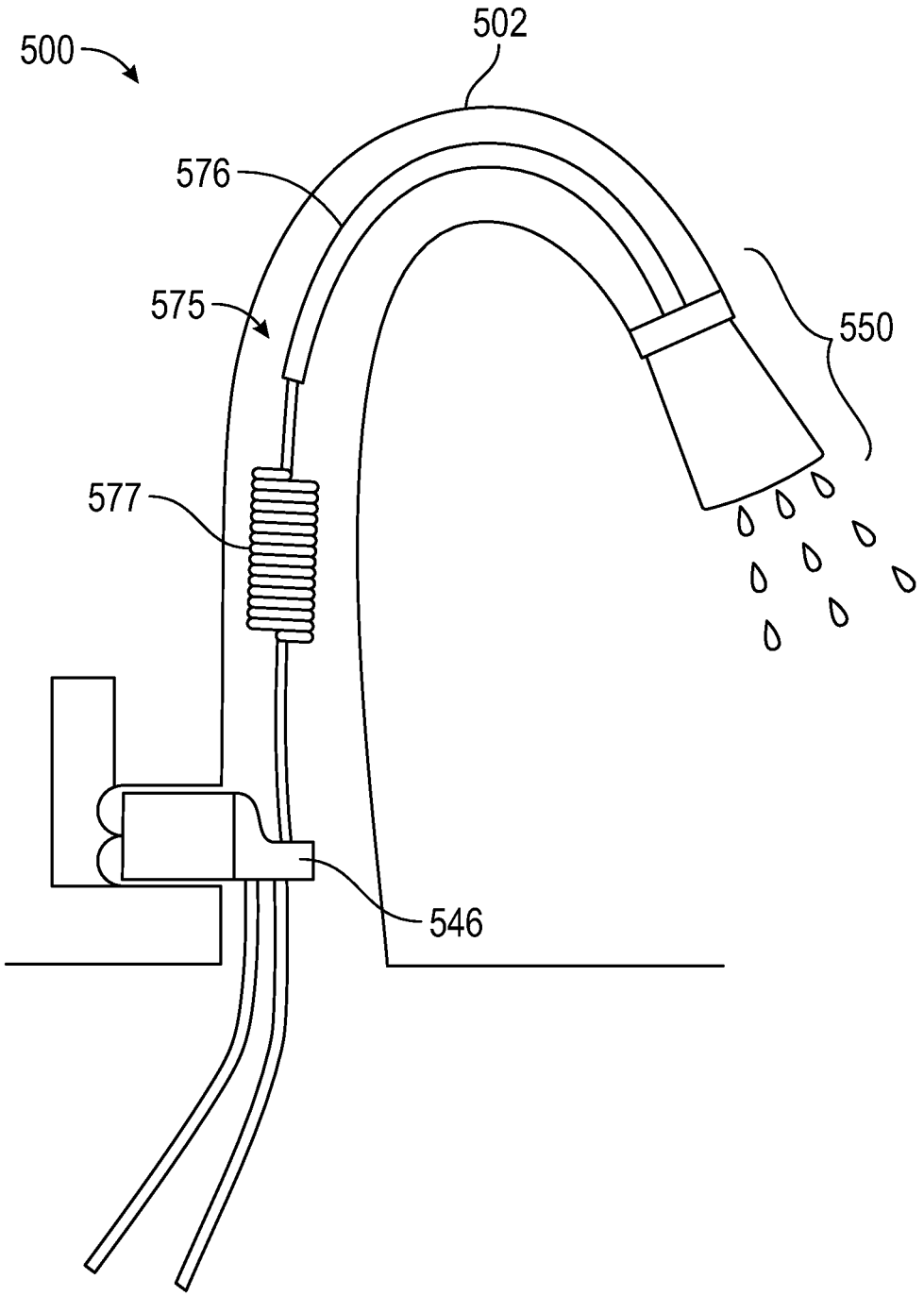
FIG. 5A and FIG. 5B show a faucet assembly comprising an expandable hose comprising a coiled section and a conventional section, according to an embodiment.
Figure 5B:
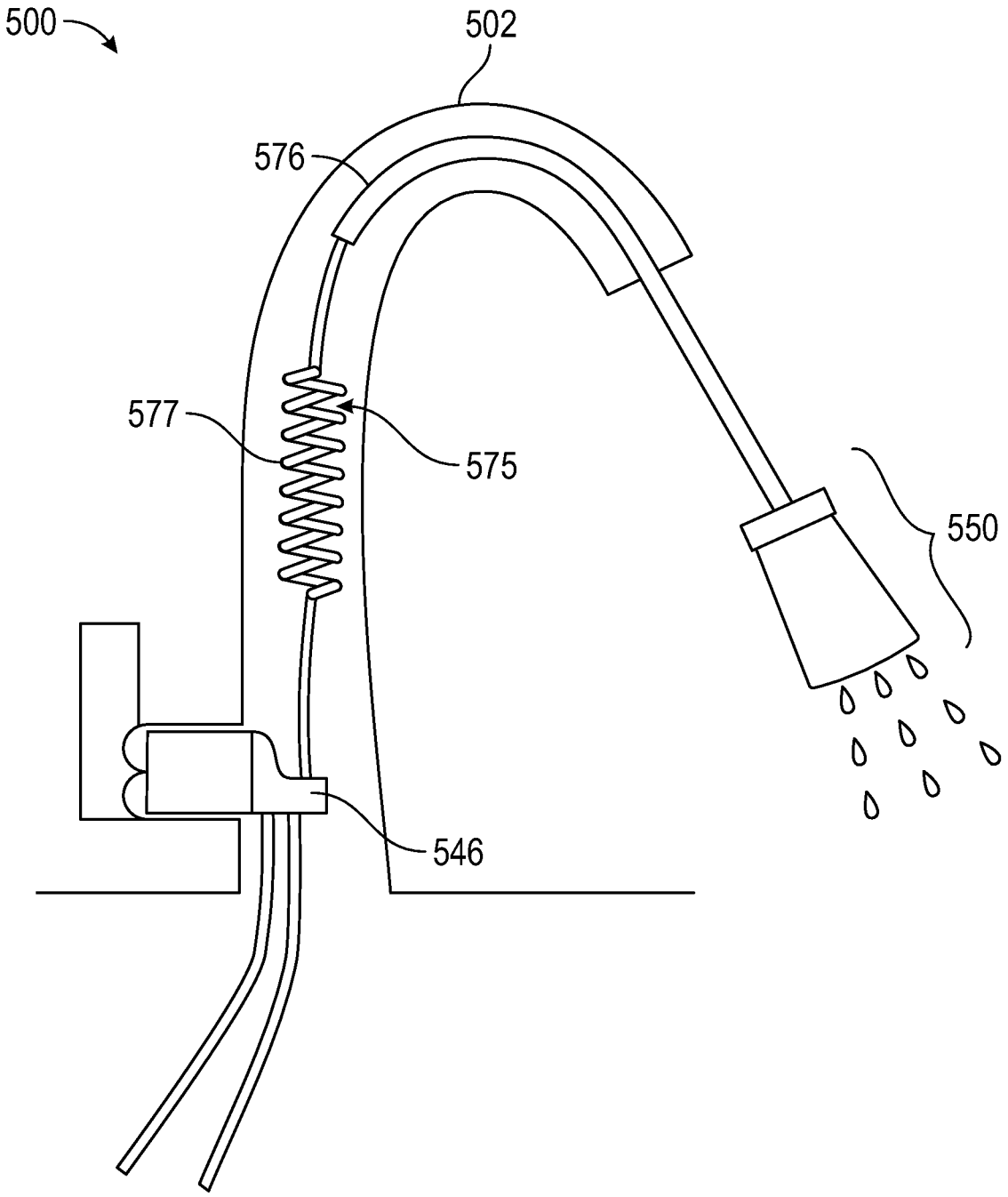

FIG. 5A and FIG. 5B show faucet assembly 500 comprising expandable hose 575 comprising conventional portion 576 and coiled portion 577, according to an embodiment. Faucet body 502 is shown in cross-section. Expandable hose 575 comprises coiled hose portion 577 coupled to mixing valve 546 and to standard conventional hose portion 576. Standard conventional hose portion 576 is coupled to spray head 550. In FIG. 5A, spray head 550 is in a docked position and hose coiled portion 577 is in a resting coiled (contracted) position. In FIG. 5B, spray head 550 is pulled out from faucet body 502, and hose coiled portion 577 is in an extended (expanded) position, where it provides a counter force allowing the spray head to be re-positioned to a docked position when desired. In this embodiment, hose coiled portion 577 is not visible to an operator upon use as it remains positioned within the faucet body. In some embodiments, coiled portion 577 may be coupled to a spring to aid in re-docking spray head 550.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims.

Following are some embodiments of the disclosure.

In a first embodiment, disclosed is a pull-out faucet assembly, comprising a faucet body comprising a proximal end and a distal end; a spray head comprising a proximal end and a distal end, the distal end comprising a water outlet, and the proximal end configured to be releasably dockable at the distal end of the faucet body; an expandable hose comprising a first end coupled to the proximal end of the spray head and a length of the expandable hose running through a length of the faucet body, wherein the expandable hose is configured to fluidly connect the water outlet to a mixing valve; and optionally a release mechanism comprising a coupling means configured to hold the proximal end of the spray head to the distal end of the faucet body when the coupling means is engaged.

In a second embodiment, disclosed is a faucet assembly of the first embodiment, wherein the expandable hose comprises an inner tubing and an outer sheath.

In in third embodiment, disclosed is a faucet assembly of the first or second embodiments, wherein the expandable hose comprises one or more coiled sections.

In a fourth embodiment, disclosed is a faucet assembly of any of the preceding embodiments, wherein the expandable hose comprises one or more coiled sections and one or more conventional hose sections.

In a fifth embodiment, disclosed is a faucet assembly according to any of the preceding embodiments, wherein the expandable hose is configured to expand radially.

In a sixth embodiment, disclosed is a faucet assembly of any of the preceding embodiments, wherein the expandable hose is configured to expand length-wise.

In a seventh embodiment, disclosed is a faucet assembly of any of the preceding embodiments, wherein the spray head is in a docked position when the coupling means of the release mechanism is engaged and holding the proximal end of the spray head to the distal end of the faucet body.

In an eighth embodiment, disclosed is a faucet assembly of any of the preceding embodiments, wherein the spray head is configured to pull away from the distal end of the faucet body when the expandable hose expands and/or the coupling means of the release mechanism is disengaged.

In a ninth embodiment, disclosed is a faucet assembly of any of the preceding embodiments, wherein the spray head is configured to remain in a docked position with the coupling means of the release mechanism engaged when the faucet is in operation.

In a tenth embodiment, disclosed is a faucet assembly of any of the preceding embodiments, wherein the expandable hose comprises one or more of rubber, latex, elastomer, or polychloroprene.

In an eleventh embodiment, disclosed is a faucet assembly of any of the preceding embodiments, wherein the coupling means of the release mechanism comprises one or more of a magnetic mechanism, a latching mechanism, a twisting mechanism, or a gripping mechanism.

In a twelfth embodiment, disclosed is a faucet assembly of any of the preceding embodiments, wherein the expandable hose is configured to fluidly connect the water outlet to the mixing valve such that a slack length of hose is not required and/or a counter weight is not required.

In a thirteenth embodiment, disclosed is a faucet assembly of any of the preceding embodiments, wherein the expandable hose comprises a bellows, or comprises a bellows and a spring.

Following are another set of embodiments.

In a first embodiment, disclosed is a pull-out faucet assembly, comprising a faucet body comprising a proximal end and a distal end; a spray head comprising a proximal end and a distal end, the distal end comprising a water outlet and the proximal end disposed at the distal end of the faucet body; a release mechanism comprising a coupling means configured to hold the proximal end of the spray head to the distal end of the faucet body when the coupling means is engaged; a hose comprising a first end coupled to the proximal end of the spray head and a length of the hose running through a length of the faucet body; and a piston mechanism coupled to a second end of the hose.

In a second embodiment, disclosed is a faucet assembly of the first embodiment, wherein the spray head is in a docked position when the coupling means of the release mechanism is engaged and holding the proximal end of the spray head to the distal end of the faucet body.

In a third embodiment, disclosed is a faucet assembly of the first or second embodiments, wherein the piston mechanism comprises a piston and a spring.

In a fourth embodiment, disclosed is a faucet assembly of any of the preceding embodiments, wherein the spray head is configured to pull away from the distal end of the faucet body when the piston slides in the faucet body and the coupling means of the release mechanism is disengaged.

In a fifth embodiment, disclosed is a faucet assembly of any of the preceding embodiments, wherein the piston is configured to slide back and forth between two positions within the faucet body, wherein the piston is in a first position when the spray head in a docked position, and the piston is in a second position when the spray head is pulled away from the distal end of the faucet body to its fullest extent.

In a sixth embodiment, disclosed is a faucet assembly of any of the preceding embodiments, wherein the piston is configured to slide between a first position and a second position when pressurized by water flow.

In a seventh embodiment, disclosed is a faucet assembly of any of the preceding embodiments, wherein the spray head is configured to remain in a docked position with the coupling means of the release mechanism engaged when the faucet is in operation.

In an eighth embodiment, disclosed is a faucet assembly of any of the preceding embodiments, wherein a spring of the piston mechanism expands when the spray head is pulled away from the distal end of the faucet body and the piston is in the second position, and the spring contracts as the spray head moves towards the distal end of the faucet body until the piston is in the first position.

In a ninth embodiment, disclosed is a faucet assembly of any of the preceding embodiments, wherein the coupling means of the release mechanism comprises one or more of a magnetic mechanism, a latching mechanism, a twisting mechanism, or a gripping mechanism.

The term "adjacent" may mean "near" or "close-by" or "next to".

The term "coupled" means that an element is "attached to" or "associated with" another element. Coupled may mean directly coupled or coupled through one or more other elements. An element may be coupled to an element through two or more other elements in a sequential manner or a non-sequential manner. The term "via" in reference to "via an element" may mean "through" or "by" an element. Coupled or "associated with" may also mean elements not directly or indirectly attached, but that they "go together" in that one may function together with the other.

The term "flow communication" means for example configured for liquid or gas flow there through and may be synonymous with "fluidly coupled" or "fluid communication". The terms "upstream" and "downstream" indicate a direction of gas or fluid flow, that is, gas or fluid will flow from upstream to downstream.

The term "electrical communication" may be synonymous with "electrically coupled" or "electrically connected" and may mean an element may send or receive electricity or electronic signals to another element, either via a wired connection or a wireless connection. The term "associated with" may mean "coupled", i.e. "electrically coupled".

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, ±5%, ±6%, ±7%, ±8%, ±9%, ±10% or more of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A pull-out faucet assembly, comprising a faucet body comprising a proximal end and a distal end;

a spray head comprising a proximal end and a distal end, wherein the spray head proximal end is configured to be releasably docked at the faucet body distal end, and the spray head distal end comprises a water outlet;

an expandable hose comprising a first downstream end coupled to the spray head proximal end, and comprising an expandable hose length running through a length of the faucet body, and a release mechanism comprising a connector, wherein the expandable hose is configured to fluidly connect the water outlet to a mixing valve, the expandable hose comprises an inner tubing and an outer sheath, wherein, when the faucet assembly is in an "on" configuration:

the inner tubing is configured to expand first radially until the inner tubing conforms to an interior of the outer sheath and then to expand length-wise, and the outer sheath is configured to restrict the inner tubing from over-expanding radially, and wherein, when the faucet assembly is in an "off" configuration:

the outer sheath is configured to collapse in size, creating a zig-zag formation with protrusions running along a circular perimeter of the inner tubing when not in a completely expanded configuration, the inner tubing is configured to contract and collapse in size when not under pressure, the connector is configured to hold the spray head proximal end to the faucet body distal end in a docked position when the connector is engaged, the spray head is configured to remain in the docked position when the connector is engaged and the faucet is in operation and the expandable hose is subjected to water pressure, and the spray head is configured to pull away from the faucet body distal end when the connector is manually disengaged.

2. The faucet assembly of claim 1, wherein the expandable hose comprises one or more coiled sections.

3. The faucet assembly of claim 1, wherein the expandable hose comprises one or more coiled sections and one or more conventional hose sections.

4. The faucet assembly of claim 1, wherein the expandable hose comprises one or more coiled sections, and wherein one or more of the coiled sections comprises a spring.

5. The faucet assembly of claim 1, comprising a piston mechanism coupled to a second upstream end of the hose, the piston mechanism comprising a piston.

6. The faucet assembly of claim 5, wherein the piston mechanism comprises the piston and a spring.

7. The faucet assembly of claim 6, wherein the spring expands when the spray head is pulled away from the faucet body, and the spring contracts as the spray head retracts towards a docked position.

8. The faucet assembly of claim 5, wherein the piston is configured to move between a first position and a second position when force is applied to the piston by water flow.

9. The faucet assembly of claim 5, wherein the piston is in a first position when the spray head is in a docked position, and the piston is in a second position when the spray head is pulled away from the faucet body.

10. The faucet assembly of claim 1, comprising a bellows mechanism coupled to a second upstream end of the hose.

11. The faucet assembly of claim 1, wherein the connector comprises one or more of a magnetic mechanism, a latching mechanism, a twisting mechanism, or a gripping mechanism.

12. The faucet assembly of claim 11, wherein the release mechanism comprises a button configured to disengage the connector.

13. The faucet assembly of claim 1, wherein the assembly does not comprise a hose slack length.

14. The faucet assembly of claim 1, wherein the assembly does not comprise a counter weight.

15. The faucet assembly of claim 1, wherein the expandable hose comprises one or more of rubber, latex, or polychloroprene.

16. The faucet assembly of claim 1, wherein the expandable hose is multi-channeled.

17. The faucet assembly of claim 10, wherein the bellows mechanism comprises a compression spring.

18. The faucet assembly of claim 1, wherein a force required for the inner tubing to expand radially is less than a force required for the inner tubing to expand length-wise.

* * * * *